United States Patent [19]

Howkins et al.

[11] Patent Number: 4,973,980

[45] Date of Patent: Nov. 27, 1990

[54] ACOUSTIC MICROSTREAMING IN AN INK JET APPARATUS

[75] Inventors: Stuart D. Howkins, Ridgefield, Conn.; John A. McCormick, Norwich, Vt.

[73] Assignee: Dataproducts Corporation, Woodland Hills, Calif.

[21] Appl. No.: 332,413

[22] Filed: Mar. 30, 1989

Related U.S. Application Data

[63] Continuation of Ser. No. 96,363, Sep. 11, 1987, abandoned.

[51] Int. Cl.[5] ..... B41J 2/045

[52] U.S. Cl. ..... 346/1.1; 346/140 R

[58] Field of Search ..... 346/140, 1.1

[56] References Cited

U.S. PATENT DOCUMENTS

| | | | |
|---|---|---|---|
| 4,459,599 | 7/1984 | Ort | 346/140 |
| 4,459,601 | 7/1984 | Howkins | 346/140 |
| 4,492,968 | 1/1985 | Lee | 346/140 |
| 4,563,688 | 1/1986 | Braun | 346/75 X |

OTHER PUBLICATIONS

Brownlow et al.; Ink on Demand Using Silicon Nozzles, IBM TDB., vol. 19, No. 6, Nov. 1976, pp. 2255–2256.

vonGotfield, R. J.; Anticlogging Ink Jet Nozzle Chamber, IBM TDB, vol. 17, No. 6, Nov. 1974, p. 1802.

Moss, J. D.; Noncontinuous Dither Excitation of DOD Ink Jet Printer, IBM TDB, vol. 27, No. 1B, Jun. 1984, pp. 837–838.

*Primary Examiner*—Joseph W. Hartary

*Attorney, Agent, or Firm*—Woodcock Washburn Kurtz Machiewicz & Norris

[57] ABSTRACT

An ink jet apparatus having a scanning head employing at least one ink jet with a variable volume chamber which includes an ink droplet ejecting orifice, and a transducer, having a length mode resonant frequency, adapted to expand and contract along an axis of elongation in response to an electric field substantially transverse to the axis of elongation for ejection of droplets on demand from the ink droplet ejecting orifice is acoustically microstreamed by exciting the transducers during non-printing periods to eliminate start-up problems and to maintain pigments or other particles in dispersion within the ink.

22 Claims, 3 Drawing Sheets

ACOUSTIC MICROSTREAMING IN AN INK JET APPARATUS

This is a continuation of application Ser. No. 096,363, filed Sept. 11, 1987, now abandoned.

BACKGROUND OF THE INVENTION

This invention relates generally to ink jet apparatus, and more particularly to ink jet apparatus and methods of operating an ink jet apparatus in order to eliminate or at least substantially reduce problems associated with such apparatus during their start-up or utilization with pigmented inks.

The problems associated with ink jet start-up are legion and notorious. Among those problems, the most significant are misfiring or non-firing of the initial ink droplets, and slower initial ink droplet velocities. Such problems are generally believed to be a result of local change in ink properties resulting from phenomena such as water absorption from the air, chemical changes, or evaporation of the ink in the nozzle of the ink jet during an idle period between firings. Heretofore, such problems were addressed in a mechanical or electrical sense. That is, added pulses or signals were used to discharge the initial drop of ink in order to prevent misfiring, and to accelerate the ink drop to normal operating speed. Such approaches, however, nearly always involved complicated waveform shaping.

Other approaches to the alleviation of such problems, such as are disclosed in U.S. Pat. No. 4,400,215 and U.S. Pat. No. 4,537,631, each of which is assigned to the assignee of the present invention and is incorporated herein by reference, instead chose to address such problems in a chemical sense (i.e., formulating new inks in order to avoid problems associated with start-up). It is readily apparent, nevertheless, that such individualized approaches to the formulation of inks that are compatible with particular ink jet apparatus would ultimately lead to unnecessary and repetitive research and development for customized applications in order to eliminate or substantially reduce the problems associated with start-up of ink jet apparatus.

Another common problem encountered with ink jet apparatus involves their use with pigmented inks. That is, during periods of non-use, the pigments contained within the ink of such ink jet apparatus have a propensity for settling out or agglomerating. One approach used in the past to eliminate such settling was the incorporation of dyes in lieu of pigments within the ink. However, as is well known, pigments provide a much more intense color than their dye counterparts in typical inks use in an ink jet apparatus. It would, therefore, be desirable to provide an ink jet apparatus utilizing pigmented inks and method of operating the ink jet apparatus to reduce or at the very least substantially eliminate problems associated with start-up, and at the same time promote dispersion of the pigments within the ink through incorporation of acoustic microstreaming in the ink jet apparatus.

A great number of industrial applications of sonic or ultrasonic waves are known which create dispersions of particles in a liquid, or of liquid droplets in a gas. Also well known is the use of such waves to provide the reverse effect of causing agglomerations of particles in a liquid, or liquid droplets in a gas. The very fact that these exactly diametrically opposite effects can be achieved through the use of ultrasonic energy indicates that at least more than one mechanism must be at work. In fact, several mechanisms have been identified that could account for the motion of suspended particles in a sound field. To consider what role these mechanisms play in an ink jet apparatus, it is convenient to classify them into three groups: (1) forces associated directly with the oscillatory motion of the sound field; (2) cavitation activity; and (3) acoustic microstreaming.

For all acoustic waves of practical amplitudes and frequencies, the particle displacement amplitude is extremely small. As an example of this, it can be shown that the particle displacement amplitude, a, for a plane wave in a liquid of density, $\rho$, and sound velocity, c, having a pressure amplitude, p, and a frequency, f, would be:

$$a = \frac{p}{2\pi\rho c f}$$

For an exemplary ink jet apparatus in which $p=10^6$ dynes/cm$^2$, $=1$ gram/cc, $c=1.5\times10^5$ cm/sec, and $f=50$ kHz, the particle displacement amplitude, a, would be on the order of approximately 2000 angstroms. Solid particles in suspension within the liquid would, therefore, have an oscillatory motion of 2000 angstroms or less. In general, heavier denser particles would undergo an oscillatory motion having much smaller amplitudes.

Associated with these motions are weak interparticle forces, and an increase in the probability of particle collisions which could lead to agglomeration. This type of mechanism has been demonstrated especially well in gases, and very often has been shown to occur in the presence of a standing wave where the resulting weak forces lead to a slow migration of the particles towards nodes or antinodes (depending upon the relative density of the particles). It can be readily appreciated therefore that, even in such a relatively simple case of a standing wave, the mechanisms involved which can result in weak forces acting on particles in suspension can be quite complicated, especially in the case where boundaries in the form of liquid/solid or liquid/air interfaces are introduced.

Another class of forces which are much stronger than forces associated with oscillatory particle motion as discussed herein above, and which are still associated with an ultrasonic wave in a liquid, are those forces resulting from cavitation activity. The most violent forces are associated with vaporous cavitation which occurs in a liquid when voids or cavities are produced in the liquid during the negative half cycle of the sound pressure wave. Cavities formed in this way collapse violently during the subsequent positive half cycle, and result in the production of a microscopic shock wave with very high pressures and temperatures. These conditions, which are typically present within an ultrasonic cleaning bath, can readily result in the breaking up of agglomerations with subsequent dispersion of the particles in a liquid. Below this threshold, however, there is another cavitation phenomenon known as stable cavitation.

Although less violent than vaporous cavitation, stable cavitation can also result in relatively large forces which may act on particles in suspension. Stable cavitation is generally associated with gas bubbles which already exist in the liquid, or which grow from dissolved gas coming out of solution under the action of the sound wave. A gas bubble in such liquids has a very high mechanical Q factor, and hence at resonance, the amplitude of motion can rapidly build up to very high levels. When this occurs, a variety of non-linear effects occur in the vicinity of the bubbles including bubble break-up and large pressure gradients in the liquid immediately surrounding the bubbles. A phenomenon known as acoustic microstreaming also occurs in the vicinity of such an oscillating bubble and can, of itself, contribute to the ultrasonic dispersion and breaking up of agglomerates in a liquid.

Acoustic microstreaming is also a non-linear effect, but one which can occur at amplitudes well below the threshold for vaporous cavitation. Although generally associated with nonlinear liquid/air oscillations, there are also situations when bubbles are not present where vigorous microstreaming can occur. Acoustic microstreaming is a steady, non-oscillatory flow of the liquid on a very small scale, usually taking the form of microscopic eddies which can be pictured in a somewhat simplistic manner as the flow resulting from small scale radiation pressure gradients. Such radiation pressure gradients can be found around regions where a sharp discontinuity exists, such as at the tip of a vibrating rod having a radiating surface the dimension of which is very small as compared with its wavelength of vibration. Radiation pressure gradients may also be found around other types of geometrical discontinuities (e.g., corners or edges) of solid surfaces in contact with the liquid.

In general, acoustic microstreaming results in a small scale stirring action in the liquid, the physical and chemical effects of which are well documented within the prior art. For example, the stirring action around the tip of a vibrating needle has been visualized by immersing the vibrating needle in a dilute solution of photographic developer just above a piece of partially exposed photographic paper, the image developed on such paper clearly showing microstreaming flow lines. The action of microstreaming in stirring the inside of living cells has also been suggested as the mechanism which explains many of the biological effects of low amplitude ultrasonic radiation. In spite of such suggestions, however, the inventors herein know of no ink jet apparatus which incorporates a means for acoustically microstreaming to eliminate or at the very least substantially reduce problems associated with their start-up, or to maintain a dispersion of pigments employed in pigmented inks.

One means and method of operating an ink jet apparatus to reduce start-up problems is disclosed in U.S. Pat. No. 4,323,908, issued to Lee et al. The Lee et al. device purges any entrapped air from the ink cavity and nozzle orifice of the print head of a drop-on-demand ink jet printer by energizing a tubular piezoelectric transducer with a series of pulses for a preselected short time period and at a repetition rate substantially equal to a resonant frequency of the ink cavity. Except during purging, the transducer operates asynchronously in drop-on-demand mode in response to discrete binary print signals.

While completely silent as to its applicability for acoustically mixing a pigmented ink, the Lee et al. device nevertheless utilizes a sinusoidal excitation of the drive transducer during non-printing periods for the purging of entrapped air form the ink cavity and nozzle orifices. However, the Lee et al. device has an extremely narrow range of operation around the frequency of device resonance. Moreover, it is evident from the teachings of Lee et al. that a stream of ink must be ejected from the nozzle orifices during purging of air therefrom, again since the device must operate at a resonance. As a result, incorporation of such a device in an ink jet printer requires a complicated head tending system to ensure the removal of excess ink purged along with the air.

Another device designed to prevent the precipitation of ink and lacquer suspensions during the operation of writing systems, especially ink jet writing systems, is disclosed in German Specification (i.e., "Offenlegungsschrift") No. 3,508,389, published Sept. 11, 1986. The device as disclosed therein, unlike the device of the above described U.S. Pat. No. 4,323,908, is adapted for pulse-type operations (i.e., always when the writing head is not in operation such as during the writing interval or carriage return) and does not release any more droplets during the writing intervals, but is adequate for the blending of the fluid.

In such a device, one or more crystal units are mounted on the ink reservoir and/or the writing grooves of a recording mechanism as described in Siemens-Zeitschrift, Volume 4, April 1977, pages 219–221. Such grooves are concentrically enclosed by transducers which contain piezoceramic tubules the energy of which, according to German Specification No. 3,508,389, is lowered during the writing intervals such that it does not release any more droplets, but is adequate for the blending of the fluid. As such, the device of the above described German Specification avoids the problems associated with the device of U.S. Pat. No. 4,323,908 in that no head tending apparatus is required for the ink which is purged from the nozzle orifices. However, such a device is limited in use with ink that does not dry up in the nozzle openings. Moreover, the device of German Specification No. 3,508,389 has a low operating frequency, and, because of the writing grooves' being long as compared with the wavelength of the transducers operating at resonance is capable of setting up standing waves, but nearly incapable of producing microstreaming (i.e., to provide the larger local intensity gradients which are required for microstreaming).

SUMMARY OF THE INVENTION

Accordingly, it is a general object of the present invention to provide a method and apparatus for eliminating or at the very least substantially reducing problems associated with start-up in ink jet apparatus. More specifically, it is an object of the present invention to substantially reduce start-up problems through the incorporation of acoustic microstreaming in drop-ondemand ink jet apparatus.

Another object of the present invention is to provide a drop-on-demand ink jet apparatus and method of operating same which breaks up agglomerations of particles contained within the inks used in such apparatus by acoustic microstreaming.

Still another object of the present invention is to provide a method and apparatus for acoustic microstreaming in a drop-on-demand ink jet apparatus such that pigments contained in pigmented inks used in such apparatus are maintained in dispersion.

A further object of the present invention is to provide a method and apparatus for substantially reducing start-up problems, and for maintaining pigments in dispersion within drop-on-demand ink jet apparatus, such that ink need not be ejected from the orifices of such apparatus thereby eliminating the necessity for complicated head tending equipment.

A still further object of the present invention is to provide a method and apparatus for acoustic microstreaming in a drop-on-demand ink jet apparatus which is adaptable for use both with conventional liquid, as well as hot melt or phase change, inks.

Briefly, the above and other objects according to the present invention are accomplished in an ink jet apparatus having a scanning head employing at least one ink jet with a variable volume chamber which includes an ink droplet ejecting orifice, and a transducer, having a length mode resonant frequency, adapted to expand and contract along an axis of elongation in response to an electric field substantially transverse to the axis of elongation for ejection of droplets on demand from the ink droplet ejecting orifice.

In accordance with one important aspect of the invention, acoustic microstreaming is induced within the apparatus by exciting the transducers associated with each variable volume chamber by a low voltage source with a predetermined waveform, preferably sinusoidal, having a predetermined range of frequencies centered about the length mode resonant frequency. While the lowest such voltage for excitation of the transducers to achieve acoustic microstreaming occurs, in accordance with the present invention, at the length mode resonant frequency, acoustic microstreaming is likewise achievable at greater or lesser frequencies by increasing the level of excitation voltage.

In accordance with yet another important aspect of the present invention, the excitation voltage is applied to the transducers for short periods of time during a carriage return cycle of the scanning print head, and during other such periods of printer inactivity to prevent problems associated with start-up and to maintain dispersion of pigments, or dissolution of dyes and other particles contained within the inks used in such ink jet apparatus.

In accordance with still another important aspect of the present invention, the geometry of the chamber must be carefully controlled to ensure that conditions are present which are conducive to acoustic microstreaming. Accordingly, the chamber length must be small as compared to the wavelength of the length mode disturbance of the transducers.

The above and other objects, advantages and novel features of the present invention will become more apparent from the following detailed description of the preferred embodiment when considered in conjunction with the accompanying drawings wherein:

DETAILED DESCRIPTION OF A PREFERRED EMBODIMENT

Figure 1:
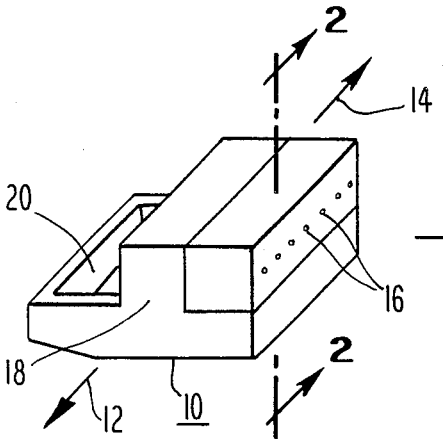
FIG. 1 is a perspective view of an ink jet apparatus representing a preferred embodiment of the present invention.

Referring now to the drawings, wherein like characters designate like or corresponding parts throughout the several views, there is shown in FIG. 1 an ink jet apparatus including an ink jet print head 10 mounted for movement along a scanning path depicted by the arrows 12 and 14. The ink jet print head 10 includes ink jet imaging systems supplying an array of ink jets having orifices 16, and an on-board or associated reservoir 18 supplied by a trough 20 located at the rear of the ink jet print head 10. The ink jet print head 10 may be suitably formed in accordance with the teachings of U.S. Pat. No. 4,459,601, issued July 10, 1984 to Stuart D. Howkins, assigned to the assignee of the present invention and incorporated herein by reference.

Figure 2:
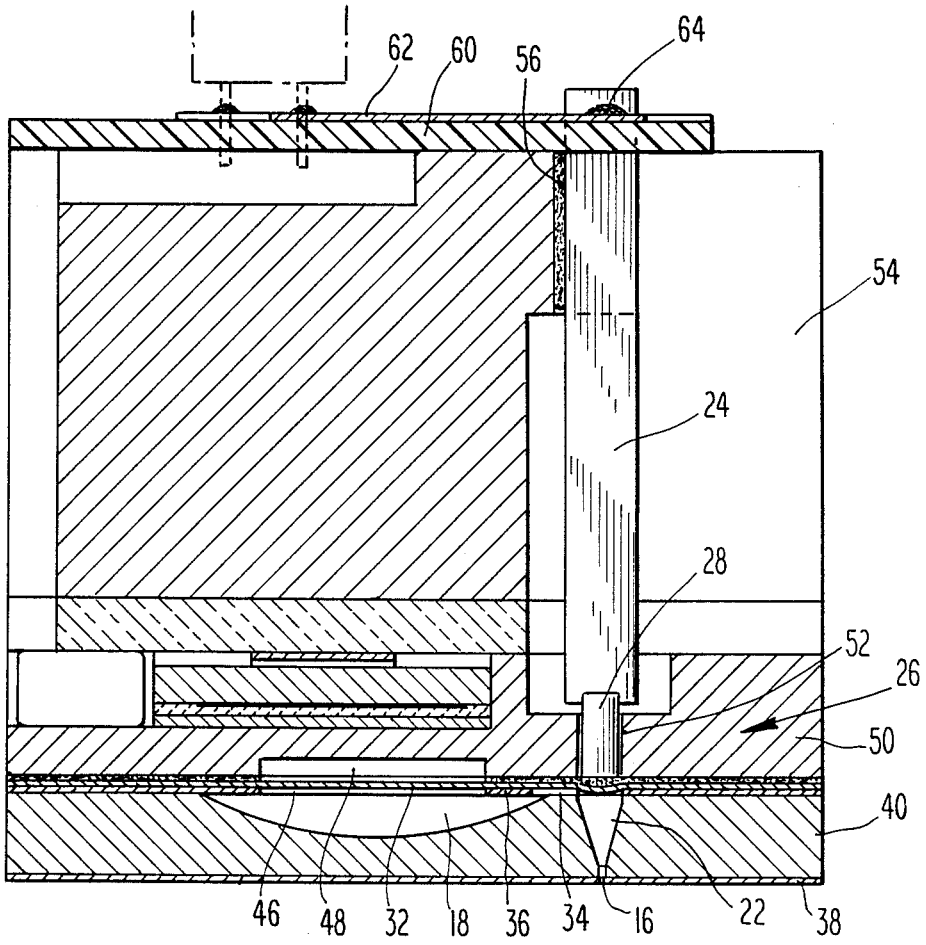
FIG. 2 is a sectional view of the ink jet apparatus shown in FIG. 1 taken along the lines 2—2.
Figure 3:
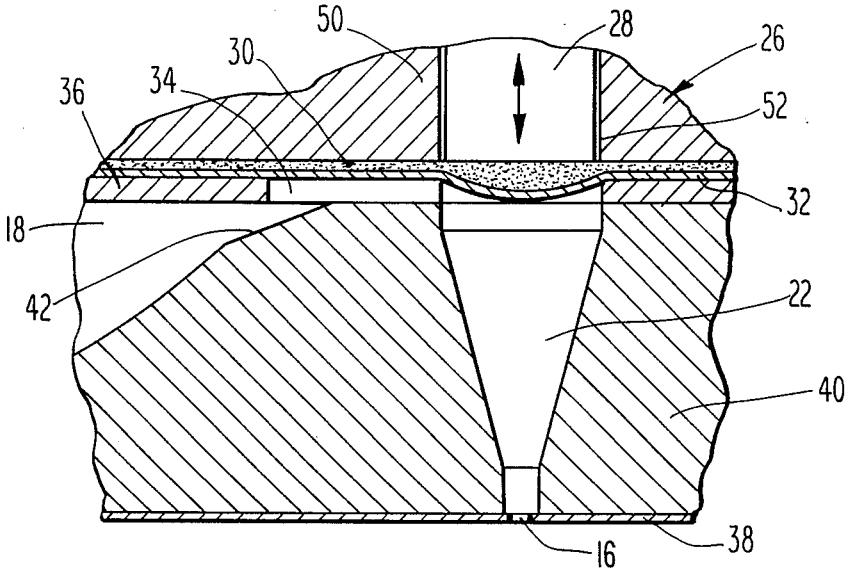
FIG. 3 is an enlarged view of a portion of the section shown in FIG. 2.

As shown more clearly in FIGS. 2 and 3, a chamber 22 having the orifice 16 ejects droplets of ink in response to the state of energization of a transducer 24 for each jet in the array. The transducer 24 expands and contracts in directions indicated by the arrows shown in FIG. 3 along the axis of elongation and the movement is coupled into the chamber 22 by coupling means 26 which includes a foot 28, a viscoelastic material 30 juxtaposed to the transducer 24 and a diaphragm 32 which is preloaded to the position shown in FIGS. 2 and 3 in accordance with the invention of U.S. Pat. No. 4,418,355, issued Nov. 29, 1983 to Thomas W. DeYoung et al., assigned to the assignee of the present invention and incorporated herein by reference.

The chamber 22 must, in accordance with an important aspect of the invention, be relatively small as compared to the wavelength of the length mode disturbance of the transducer 24. That is, the wavelength of the length mode disturbance is preferably approximately 20 times the chamber length as defined in U.S. Pat. No. 4,459,601. Such a relationship ensures that the geometrical characteristics of the chamber 22 (i.e., corners, discontinuities, etc.) are small enough to be conducive to acoustic microstreaming.

Ink flows into the chamber 22 from the unpressurized reservoir 18 through restricted inlet means provided by a restricted opening 34, comprising an opening in a restrictor plate 36. In accordance with one important aspect of the invention, the cross-sectional area of the ink flowing into the chamber 22 through the inlet 34 is substantially constant during expansion and contraction of the transducer 24, notwithstanding the location of the inlet 34 immediately adjacent the coupling means 26 and the transducer 24. By providing the inlet 34 with an appropriate size vis-a-vis the orifice 16 in an orifice plate 38, the proper relationship between the inertance at the inlet 34 and the inertance at the orifice 16 may be maintained.

As shown in FIG. 3, the reservoir 18 which is formed in a chamber plate 40 includes a tapered edge 42 leading into the inlet 34 which is the invention of U.S. Pat. No. 4,424,521, issued Jan. 3, 1981 to Arthur M. Lewis et al., assigned to the assignee of the present invention and incorporated herein by reference. In order to minimize mechanical crosstalk through the ink in the chamber 22, the reservoir 18 is compliant by virtue of the diaphragm 44 which is in communication with the ink through a large opening 46 in the restrictor plate 36 which is juxtaposed to an area of relief 48 in the plate 50 as shown in FIG. 2. In order to minimize fluidic crosstalk, each jet in the array is isolated from the ink and communication with a single chamber 22.

In accordance with U.S. Pat. No. 4,439,780, issued Mar. 27, 1984 to Thomas W. DeYoung et al., assigned to the assignee of the present invention and incorporated herein by reference, each of the transducers 24 as shown in FIG. 2 is guided at the extremities thereof with intermediate portions of the transducer 24 being essentially unsupported as best shown in FIG. 2. One extremity of the transducer 24 is guided by the cooperation of the foot 28 with a hole 52 in the plate 50. As shown in FIG. 2, the hole 52 in the plate 50 is slightly larger in diameter than the diameter of the foot 28. As a consequence, there need by very little contact between the foot 28 and the wall of the hole 52 with the bulk of contact which locates the foot 28 and thus supports the transducer 24 coming with the viscoelastic material 30 best shown in FIG. 3. The other extremity of the transducer 24 may be compliantly mounted in a block 54 by means of a compliant or elastic material 56 such as silicone rubber. The compliant material 56 is located in slots 58 shown in FIG. 2 to provide support for the other extremity of the transducer 24. Electrical contact with the transducer 24 is also made in a compliant manner by means of a compliant printed circuit 60, having conductive patterns 62 printed thereon, which is electrically coupled by suitable means such as solder 64 to the transducer 24. As an alternative to the solder 64, the transducer 24 may be mounted to the block 54 by means of a silver conductive epoxy, thereby eliminating the need for the compliant material 56. Further details relating to the structure and operation of the above described ink jet apparatus may be found in the aforementioned U.S. Pat. No. 4,459,601.

Figure 4A:
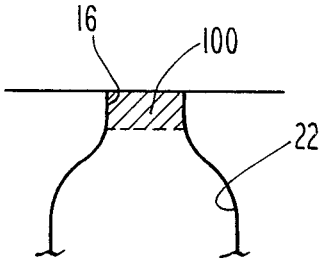
FIGS. 4*a*, 4*b*, and 4*c* illustrate various problems associated a start-up of the ink jet apparatus shown in FIGS. 1–3.
Figure 4B:
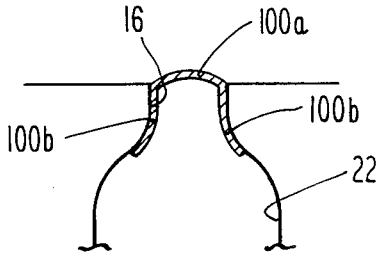
Figure 4C:
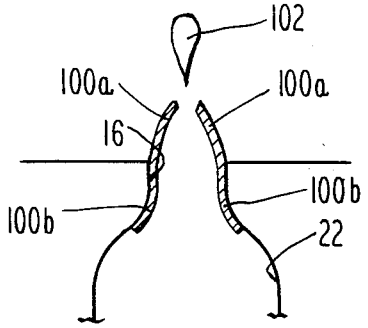

Referring now to FIGS. 4a–4c there are shown several problems associated with start-up of typical ink jet apparatus such as the described immediately herein above. When a drop-on-demand ink jet is first turned on after an idle period, there are a number of phenomena which cause the jet performance to exhibit differences from the steady running condition. These differences may range from a small change in droplet velocity to a complete failure to fire, and they may last for an indeterminate period of time if no steps are taken to intervene. Such problems are generally manifested by poor print quality, or no print in extreme cases, when the printer is first turned on, and may require a substantial period of running or sometimes head tending to rectify same.

The underlying causes of such problems may be one or more of several different mechanisms, including for example evaporation of the ink causing a change in the ink's properties within the orifice. In general, these mechanisms fall into two categories: (1) a change in the properties of the ink in the orifice in the whole of the orifice region; and (2) a change in the properties of the ink in a region around the ink boundary within the orifice and/or the air. In the first case, as illustrated in FIG. 4a, the altered ink 100 will soon be purged from the orifice 16 and the problem will be fairly short lasting. In the second case as shown in FIGS. 4b and 4c, however, "altered ink" not only may occur along the ink/air interface 100a, but also along the ink/solid interface 100b. During firing of the jet, the ink/air interface 100a may rupture (FIG. 4c) allowing a droplet 102 to be ejected from the orifice 16, but the orifice 16 will remain essentially unpurged.

It has been discovered, nevertheless, that while the altered ink at the ink/air interface 100a is not readily removed by firing the jet (since such interface 100a is very thin and the hydrodynamic boundary layer associated with its motion results in only very small shear forces), the altered ink layer can be disturbed by acoustic microstreaming. Furthermore, through utilization of acoustic microstreaming in an ink jet apparatus using pigmented inks, dispersion of the pigments contained within the pigmented inks may be readily maintained.

Figure 5:
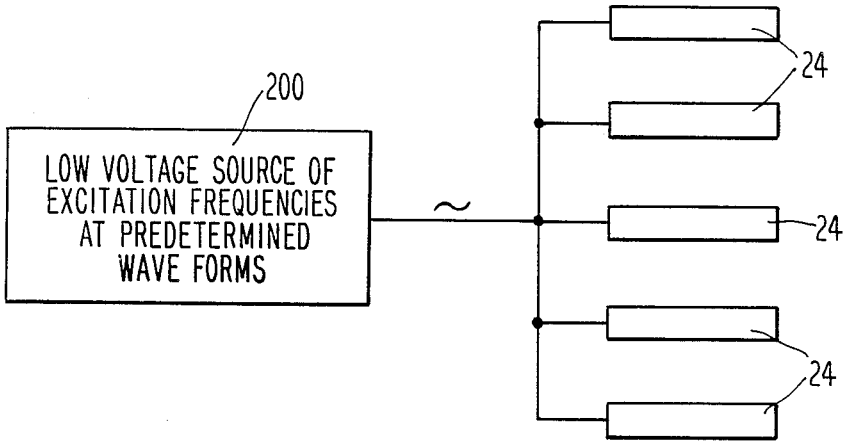
FIG. 5 is a block diagram depicting a method of acoustic microstreaming to eliminate the problems illustrated in FIGS. 4*b* and 4*c*, as well as to maintain dispersion of pigments in pigmented inks used in the ink jet apparatus according to the present invention.

Referring now to FIG. 5 in conjunction with the ink jet apparatus shown in FIGS. 1–3, a method and apparatus for acoustic microstreaming in an ink jet apparatus will now be described. Each transducer 24 is excited, preferably sinusoidally, by a signal from a low voltage source 200 at frequencies within a predetermined range about the length mode resonant frequency of the transducers 24. Such a signal may be generated by a simple oscillator or a conventional signal generator. For example, in this preferred embodiment of the present invention, the length mode resonant frequency is approximately 55 kilohertz. At such a frequency, the source 200 is required to output the sinusoidal signal at a level of approximately one volt R. M. S. In any case, the transducers 24 are so excited for a brief period of time (i.e., on the order of one second or less), preferably during periods of printer inactivity such as between carriage return cycles of the scanning print head 10 (FIG. 1). The same effect, however, can be achieved over a frequency range from about 10 kilohertz to about 100 kilohertz by increasing the excitation voltage somewhat. For example, in order to achieve acoustic microstreaming off resonance within the above frequency range, an excitation voltage of less than approximately 100 volts, preferably 60–70 volts, and even more preferably 1–10 volts is required. The level of excitation voltage in any case should be less than the drive voltage of the transducers 24. In this manner, excitation of the transducers 24 in order either to prevent start-up problems or to promote the dispersion of pigments within pigmented inks will not interfere with normal printer operations.

Figure 6:
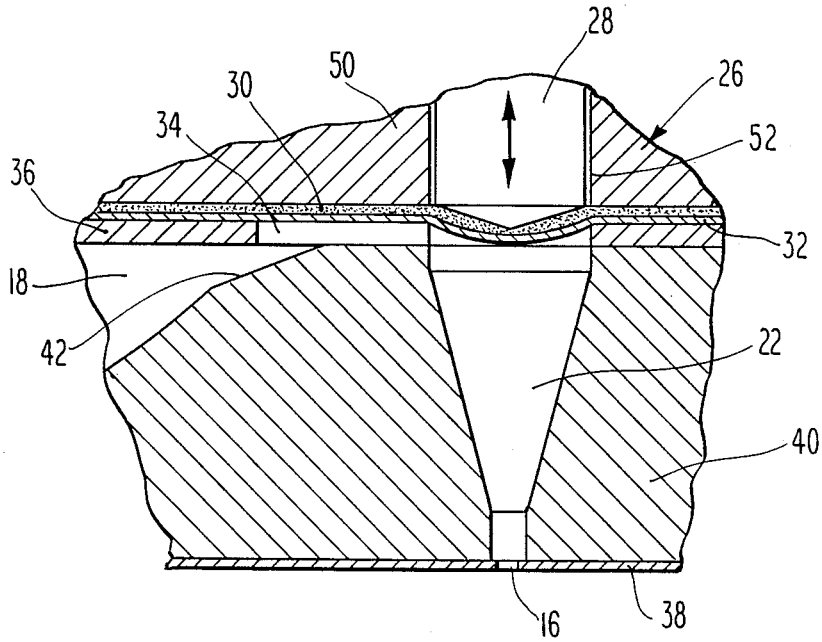

Obviously, many modifications and variations of the present invention are possible in light of the above teachings. For example, optimization of the acoustic microstreaming by concentrating the intensity changes around the tip of the foot 28 may be accomplished by varying the shape of the foot 28. That is, the foot 28 may comprise a generally cylindrical shape with a flat front surface proximate to the orifice 16 as shown in FIGS. 2 and 3, or may be alternatively comprised of a substantially conical shape having the point of the cone situated proximate to the orifice 16 in order to concentrate the intensity changes associated with the low voltage sinusoidal signal applied to the transducers 24 as described herein above as shown in FIG. 6. Furthermore, it should be noted at this juncture that the method and apparatus herein taught can be utilized both with liquid and with hot melt or phase change inks. Such inks are variously described in the following patents, each of which are assigned to the assignee of the present invention and incorporated herein by reference: U. S. Pat. Nos. 4,386,961; 4,390,369; and 4,484,948.

It is, therefore, to be understood that within the scope of the appended claims the invention may be practiced otherwise than as specifically described above.

What we claim is:

1. An ink jet apparatus, comprising:

a variable volume chamber having an ink droplet ejection orifice;

a transducer adapted to expand and contract along an axis of elongation in response to an electric field substantially transverse to the axis of elongation, said transducer having a length mode resonant frequency;

means for coupling said transducer to said chamber thereby expanding and contracting said chamber to eject droplets of ink through said orifice on demand in response to the expansion and contraction of said transducer along its axis of elongation; and means for causing acoustic microstreaming in said chamber at a frequency of approximately said length mode resonant frequency, said microstreaming means coupled to said transducer for excitation thereby with a signal having a waveform adapted to cause a substantially steady, non-oscillatory flow of ink in said chamber;

whereby said coupling means includes means for concentrating intensity changes in the ink within said chamber around said coupling means associated with said signal.

2. The apparatus according to claim 1, wherein said microstreaming means comprises a low voltage signal source outputting a substantially sinusoidal signal to said transducer.

3. The apparatus according to claim 2, wherein said substantially sinusoidal signal output from said low voltage source comprises a predetermined frequency selected from a range of frequencies about said length mode resonant frequency.

4. The apparatus according to claim 3, wherein said predetermined frequency comprises a frequency substantially equal to said length mode resonant frequency.

5. The apparatus according to claim 4, wherein said substantially sinusoidal signal output from said low voltage source comprises a root mean square voltage about one volt.

6. The apparatus according to claim 3, wherein said range of frequencies comprises from about 10–100 kilohertz.

7. The apparatus according to claim 6, wherein said substantially sinusoidal signal output from said low voltage source comprises less than 100 volts.

8. The apparatus according to claim 7, wherein said substantially sinusoidal signal output from said low voltage source comprises from 60–70 volts.

9. The apparatus according to claim 7, wherein said substantially sinusoidal signal output from said low voltage source comprises from 1–10 volts.

10. The apparatus according to claim 4, wherein said substantially sinusoidal signal output from said low voltage source is applied to said transducer for a predetermined period of time.

11. The apparatus according to claim 10, wherein said predetermined period of time comprises less than one second.

12. The apparatus according to claim 1, wherein said coupling means includes a foot member attached to said transducer proximate said chamber, said foot member having a predetermined geometry selected to optimize said microstreaming means.

13. The apparatus according to claim 12, wherein said predetermined geometry comprises a substantially cylindrical shape having a flat face portion opposing said droplet ejecting orifice.

14. The apparatus according to claim 12, wherein said preselected geometry comprises a substantially conical shape having a pointed tip portion opposing said droplet ejecting orifice.

15. A method of dispersing pigments contained within an ink used in an ink jet apparatus of the type having a scanning print head including a variable volume chamber with a droplet ejecting orifice, a transducer adapted to expand and contract along an axis of elongation in response to an electric field substantially transverse to the axis of elongation, the transducer having a length mode resonant frequency, means for coupling the transducer to the chamber thereby expanding and contracting the chamber to eject droplets of ink through the orifice on demand in response to expansion and contraction along the axis of the transducer, and means for exciting the transducer, comprising the steps of:

scanning the print head in a first direction;

printing preselected characters through ejection of ink droplets from the orifice by exciting the transducer with a first predetermined waveform;

scanning the print head in a second direction opposite said first direction;

exciting the transducer with a second predetermined waveform at a frequency of approximately said length mode resonant frequency adapted to cause a substantially steady, non-oscillatory flow of ink in the chamber during scanning in said second predetermined direction to cause acoustic microstreaming within ink jet apparatus; and concentrating intensity changes in the ink within the chamber around the coupling means associated with said second predetermined waveform by providing said coupling means with sharp discontinuities.

16. The method according to claim 15, wherein said exciting step comprises the steps of:

selecting a frequency of excitation from a predetermined range of frequencies about said length mode resonant frequency;

applying said second predetermined waveform to said transducers at a predetermined voltage; and removing said second predetermined waveform from said transducers after a preselected time of application thereto.

17. The method according to claim 16, wherein said range second predetermined waveform comprises a substantially sinusoidal waveform.

18. The method according to claim 16, wherein said predetermined range of frequencies from about 10–100 kilohertz.

19. The method according to claim 16, wherein said predetermined voltage comprises about one volt root mean square.

20. The method according to claim 16, wherein said predetermined time of application comprises less than one second.

21. An ink jet apparatus with an array of ink jets, each said ink jet comprising:

a variable volume chamber having an ink droplet ejection orifice, said chamber being of a predetermined length;

a transducer adapted to expand and contract along an axis of elongation in response to an electric field of predetermined strength substantially transverse to the axis of elongation, said transducer having a length mode resonant frequency;

means for coupling said transducer to said chamber thereby expanding and contracting said chamber to eject droplets of ink through said orifice on demand in response to expansion and contraction along the axis of the transducer; and means for causing acoustic microstreaming in said chamber at a frequency of approximately said length mode resonant frequency, said microstreaming means including a low voltage signal source, coupled to said transducer for excitation thereby with a signal having a waveform adapted to cause a substantially steady, non-oscillatory flow of ink in said chamber;

wherein said signal has a voltage level less than the predetermined strength of said electric field, wherein said chamber length is substantially less than a wavelength of length mode disturbance of said transducer, and wherein said coupling means includes means for concentrating intensity changes in the ink around said coupling means associated with said signal.

22. The apparatus according to claim 21, wherein said wavelength of the length mode disturbance comprises approximately 20 times said chamber length.

* * * * *